US006358151B1

(12) United States Patent
Enzminger et al.

(10) Patent No.: US 6,358,151 B1
(45) Date of Patent: Mar. 19, 2002

(54) SYSTEM FOR FACILITATING GAME PLAY IN AN ELECTRONIC LOTTERY GAME NETWORK

(75) Inventors: Joseph R. Enzminger; Jefferson C. Lind; Clifton Lind, all of Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 0 days.

(21) Appl. No.: 09/503,651

(22) Filed: Feb. 14, 2000

(51) Int. Cl.[7] ..... A63F 9/24
(52) U.S. Cl. ..... 463/43; 463/42
(58) Field of Search ..... 463/1, 16, 17, 463/30, 31, 40, 42, 43, 44

(56) References Cited

U.S. PATENT DOCUMENTS

| | | | | |
|---|---|---|---|---|
| 4,494,197 A | | 1/1985 | Troy et al. | |
| 4,652,998 A | | 3/1987 | Koza et al. | 364/412 |
| 4,842,278 A | * | 6/1989 | Markowicz | 273/138 A |
| 5,042,809 A | | 8/1991 | Richardson | |
| 5,092,598 A | | 3/1992 | Kamille | |
| 5,324,035 A | | 6/1994 | Morris et al. | |
| 5,407,199 A | | 4/1995 | Gumina | |
| 5,830,067 A | * | 11/1998 | Graves et al. | 463/40 |
| 5,871,398 A | | 2/1999 | Schneier et al. | |
| 6,017,032 A | * | 1/2000 | Grippo et al. | 273/138.1 |
| 6,024,640 A | | 2/2000 | Walker et al. | |
| 6,082,887 A | * | 7/2000 | Feuer et al. | 364/410.1 |

* cited by examiner

*Primary Examiner*—Jessica J. Harrison
*Assistant Examiner*—Kim T. Nguyen
(74) *Attorney, Agent, or Firm*—Russell D. Culbertson; Shaffer & Culbertson, LLP

(57) ABSTRACT

Pools of game play records (25) used in lottery-type games are stored at each player terminal (14) in a network which includes at least one player terminal and least one central processing system (12). The central processing system (12) is responsible for receiving game play requests from the player terminals (14) and, in response to each game play request, providing game play record identifying information (32) to the player terminal from which the game play request originated. This game play record identifying information (32) allows the player terminal (14) to access the identified game play record (25) and use information from the game play record to communicate to the player the result of the game play.

20 Claims, 3 Drawing Sheets

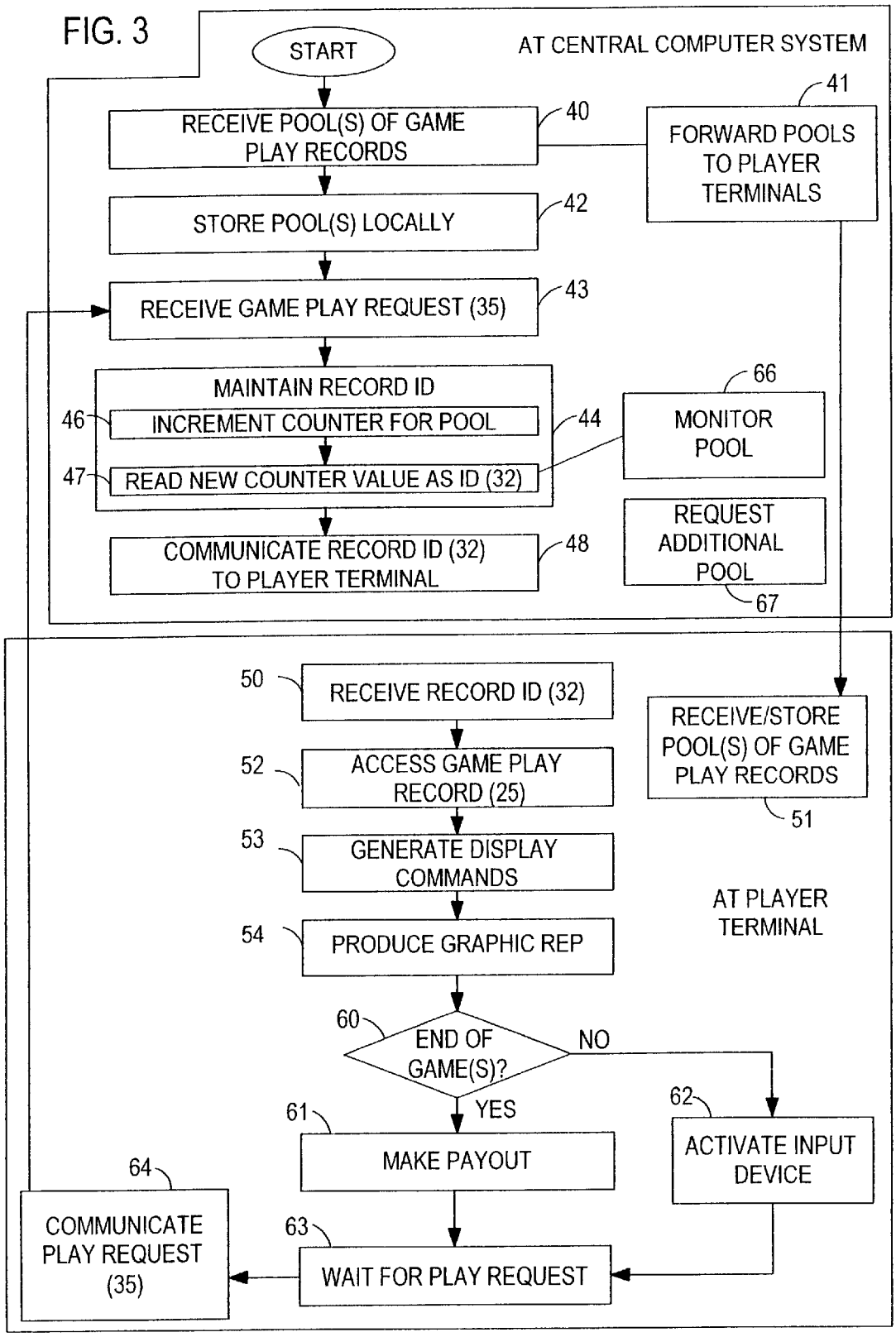
FIG. 3
START
AT CENTRAL COMPUTER SYSTEM
RECEIVE POOL(S) OF GAME PLAY RECORDS
40
FORWARD POOLS TO PLAYER TERMINALS
41
STORE POOL(S) LOCALLY
42
RECEIVE GAME PLAY REQUEST (35)
43
MAINTAIN RECORD ID
46
INCREMENT COUNTER FOR POOL
47
READ NEW COUNTER VALUE AS ID (32)
44
MONITOR POOL
66
REQUEST ADDITIONAL POOL
67
COMMUNICATE RECORD ID (32) TO PLAYER TERMINAL
48
RECEIVE RECORD ID (32)
50
ACCESS GAME PLAY RECORD (25)
52
GENERATE DISPLAY COMMANDS
53
PRODUCE GRAPHIC REP
54
RECEIVE/STORE POOL(S) OF GAME PLAY RECORDS
51
AT PLAYER TERMINAL
END OF GAME(S)?
60
NO
YES
MAKE PAYOUT
61
ACTIVATE INPUT DEVICE
62
WAIT FOR PLAY REQUEST
63
COMMUNICATE PLAY REQUEST (35)
64

SYSTEM FOR FACILITATING GAME PLAY IN AN ELECTRONIC LOTTERY GAME NETWORK

CROSS-REFERENCE TO RELATED APPLICATIONS

This application is related to prior U.S. patent application Ser. No. 09/479,975, filed Jan. 10, 2000, and entitled MULTI-LEVEL LOTTERY-TYPE GAMING SYSTEM WITH PLAYER-SELECTED SECOND LEVEL GAME. The entire content of this prior related application is incorporated herein by this reference.

TECHNICAL FIELD OF THE INVENTION

This invention relates to electronically implemented games of chance and, more particularly, to data communications in electronic lottery-type games. The invention encompasses a method and apparatus for facilitating game play in an electronic lottery-type game, and a program product for facilitating the play of the game.

BACKGROUND OF THE INVENTION

Lottery-type games are popular sources of revenue for governmental agencies and charitable organizations. As used in this disclosure, a "lottery-type game" comprises a game having a predetermined number of payouts or prizes and a determined chance of winning. For example, a lottery-type game may comprise a scratch-off or pull-tab game having a number of preprinted tickets. Each ticket has some type of printed result indicator which indicates if the particular ticket is a winning ticket and, if the ticket is a winning ticket, indicates the prize or payout. The result indicator is commonly covered with some opaque cover material which may be scratched off or otherwise removed to reveal the indicator below. Thus, the ticket purchaser cannot see if the ticket is a winning ticket until purchasing the ticket and removing the opaque cover material.

Lottery-type games may be implemented through computer-based, electronic systems. Prior related U.S. patent application Ser. No. 09/479,975, describes an electronic, multi-level lottery type game in which the play of the game may imitate a regular casino game. However, the game described in this prior application is played with pools of game play records having predetermined outcomes similar to standard paper ticket based lottery games. Thus, the game provides the excitement of a regular casino-type game such as draw poker, for example, but with the security, verifiability, and fixed chances of winning provided by paper ticket based lottery games.

Electronic lottery-type games may be implemented using a central processing system for storing the various pools of game play records and for distributing the game play records to player terminals which are in communication with the central processing system. The player terminals provide a display device for displaying information to the player, an arrangement for accepting a wager, and an arrangement for providing inputs from the player. A player enters the electronically implemented lottery-type game by making a game play request at a player terminal. In response to a game play request entered by the player, the central processing system sends information regarding a particular game play record to the player terminal. The player terminal then displays the information regarding the game play, and, in the case of the system described in prior related application Ser. No. 09/479,975, allows the player to make a response. This response enters the player in another or second level lottery-type game and results in information regarding a second level game play being communicated from the central processing system to the player terminal.

The prior electronic game described in U.S. Pat. No. 5,324,035 to Morris et al. incorporates all information required to define a game play into a video ticket. The incorporated information includes data for the various graphic symbols to be displayed to the player through the player terminal. This arrangement results in relatively large amounts of data having to be transferred to the player terminal for each game play.

The prior electronic game described in U.S. Pat. No. 4,494,197 to Troy et al. utilizes a counter register and winning ticket table at a central processor. In response to a play request from a player terminal, the value in the counter register is incremented and then the winning ticket table is queried to determine if the resulting count corresponds to a winning electronic ticket. The central processor then sends back to the player terminal a packet of information including a winning or losing code as appropriate. The winning code includes the amount won on the play. The Troy Patent also suggests using the amount won to produce a graphic representation of the result at the player terminal. Using the amount won to control the graphics displayed at a player terminal, however, constrains the payout structure and graphics available in the game.

SUMMARY OF THE INVENTION

It is an object of the invention to provide a system which overcomes the above-described deficiencies and others in prior electronic lottery-type games. More particularly, it is an object of the invention to provide a method which reduces the amount of data transferred to the player terminals to communicate a game play in an electronic lottery-type game, and which provides flexibility in payout schedules as well as flexibility in the types of graphics employed in the game. A further object of the invention is to provide an apparatus and program product to implement the method.

In order to accomplish these objects, the pools of game play records used in the lottery-type games are stored at each player terminal in the network. The network includes at least one player terminal and at least one central processing system. The central processing system is responsible for receiving game play requests from the player terminals and, in response to each game play request, providing game play record identifying information to the player terminal from which the game play request originated. This game play record identifying information allows the player terminal to access the identified game play record and use information from the game play record to communicate to the player the result of the game play.

In the preferred form of the invention, the central processing system maintains record identifiers. Each record identifier is uniquely associated with a particular game play record in a pool of game play records stored at one or more player terminals. The central processing system provides game play record identifying information to a player terminal by communicating a particular record identifier to the player terminal.

In this arrangement in which game play records are stored at the player terminals, the only information communicated to a player terminal in response to a game play request is the record identifier and, in some forms of the invention, a pool identifier. This pool identifier may be incorporated into the record identifier or may be a separate index or identifier value. The amount of information which must be communicated to a player terminal in response to a game play request is minimized by using record identifiers to identify or point to game play records already stored at the player terminal. This helps ensure that network communications do not interfere with the play of the game.

Each player terminal used in a lottery-type game network according to the invention includes a game pool storage device for storing at least one and usually a number of different pools of game play records. Each player terminal also includes a record access arrangement. This record access arrangement uses the record identifier communicated from the central processing system to access a particular game play record in a pool and obtain information stored in the game play record. A display processor at the player terminal then uses the information acquired from the particular game play record to produce display commands which direct a display at the player terminal to produce a graphic representation. This graphic representation displays the results of the game play to the player, and may be designed to imitate a casino-type game as described in the prior related application Ser. No. 09/479,975.

A central processing system according to the invention includes a game play processor and an identifier arrangement for maintaining the record identifiers employed in the system. The game play processor is adapted to receive game play requests from the player terminals in the network and to select a different record identifier for communication back to the player terminal in response to each respective game play request. The primary purpose of the central processing system is to service game play requests and coordinate the use of game play records as between the various player terminals in the network. In particular, the coordination provided by the game play processor at the central computer system ensures that each game player record in a game pool is used only once.

The identifier arrangement at the central processing system may maintain the record identifiers in the form of a set of indexes, with each index value identifying or pointing to a different game play record in a given pool of records. In one form of the invention the index value may be included within the game play record itself and a duplicate pool of game play records may be stored at the central processing system. In another preferred form of the invention, each record identifier may comprise a counter value. In this case the identifier arrangement may utilize a counter value which is incremented for each received game play request. The resulting counter value is returned to the player terminal from which the game play request originated and is used to access a particular game play record.

The invention is preferably implemented using computer software code executed by suitable processors associated with both the central processing system and each player terminal. Program code executed at the central processing system includes request processing program code for processing game play requests and identifier program code responsible for maintaining the record identifiers. Program code executed at a player terminal includes record storage code causing the pools of game play records to be stored at the respective player terminal and record accessing code for accessing the desired game play record using a record identifier.

Utilizing record identifiers to access game play records stored at the individual player terminals according to the present invention reduces the amount of data which must be communicated from the central processing system to the player terminal to respond to each game play request. The present record identifier arrangement also provides a great deal of flexibility in the play of the lottery-type games and flexibility in payout schedules used in the games. In particular, the use of record identifiers according to the invention facilitates the play of multi-level, interrelated lottery-type games which can be used together to closely imitate casino-type games while providing all of the verifiability of lottery-type games.

These and other objects, advantages, and features of the invention will be apparent from the following description of the preferred embodiments, considered along with the accompanying drawings.

BRIEF DESCRIPTION OF THE DRAWINGS

FIG. 3 is a flow chart illustrating a method embodying the principles of the invention and using the apparatus and data structures shown in FIGS. 1 and 2.

DESCRIPTION OF THE PREFERRED EMBODIMENTS

Figure 1:
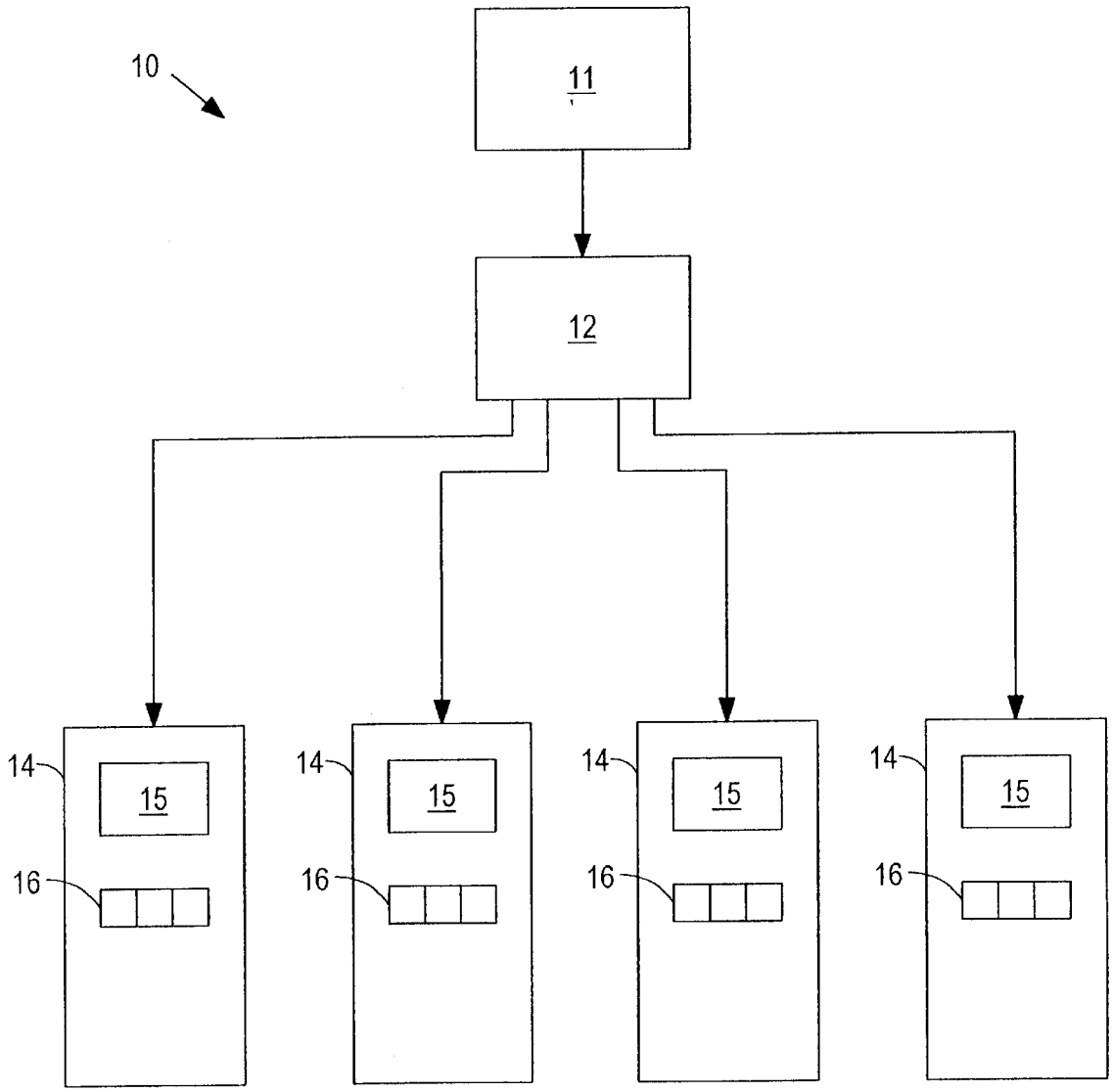
FIG. 1 is a diagrammatic representation of a gaming apparatus embodying one preferred form of the invention.

FIG. 1 shows a gaming apparatus 10 embodying the principles of the invention. The form of the invention shown in FIG. 1 is adapted to implement a gaming method described below with reference to FIG. 3. The invention is particularly well suited for implementing multi-level, interrelated lottery-type games which imitate casino-type games as described in prior related application Ser. No. 09/479,975. As with any electronic lottery-type game, the gaming apparatus and method according to the invention employ one or more pools of game records. Each game record is analogous to a scratch-off or pull-tab paper lottery ticket in that the status of the record as a winning or a losing record is predetermined. However, the game records in the electronic lottery-type games comprise electronic data structures rather than physical tickets.

In the form of the invention illustrated in FIG. 1, the game records are created at a game manufacturing computer system 11 and then stored in a game record storage device associated with a central computer system 12. Central computer system 12 is connected to communicate via suitable means with a plurality of player terminals 14. Although four player terminals 14 are shown in FIG. 1 for purposes of illustrating the invention, any number of player terminals may be included in an apparatus embodying the principles of the invention. Each player terminal 14 includes a display 15 for displaying various game representations, and further includes an input device 16 for receiving player inputs such as game play requests. The input device 16 may comprise any type of input arrangement including one or more push button, key, or lever activated switches. Also, the input device may comprise a touch screen and thus be integrated with the display 15. Although not shown in the drawings, each player terminal 14 may also include an arrangement for receiving payments from a player and an arrangement for making payouts to the player. Payouts may be made using a coin or token dispensing arrangement (not shown) included in player terminal 14. Alternatively, or in addition to a coin dispensing arrangement, player terminal 14 may include a printer (not shown) for printing a ticket showing the player's winnings. The player may redeem this ticket through a game operator, for example. Also, a monitoring arrangement separate from player terminals 14 may monitor winnings, and a player may be required to redeem winnings or credits at a cashier or monitoring station.

Game records for the different games used in the invention may be generated by any suitable means. For example, once a desired quantity of each potential result is determined for a particular game, that number of game records for each result may be generated by a suitable method. Once the records are generated, they may be shuffled or otherwise randomized electronically in a separate randomization step. Both the game record generation and randomization may be performed at a separate game manufacturing system such as system 11 shown in FIG. 1.

The randomized game records may be arranged in groups, and groups of randomized game records may be transferred for distribution or sale through one or more separate player terminals shown in FIG. 1. These groups of randomized game records are analogous to books of scratch-off tickets distributed to lottery retailers. As will be discussed in detail below with reference to FIGS. 2 and 3, the randomized game records for each game are stored locally at the various player terminals 14 and distributed sequentially. This sequential distribution is analogous to the distribution of scratch-off tickets by a retailer.

In the embodiment of the invention shown in FIG. 1, central computer system 12 is responsible for ensuring game records are used properly among the various player terminals. As will be discussed in detail below with respect to FIGS. 2 and 3, central computer system 12 carries out this responsibility by processing play requests transmitted from the various player terminals and returning information to the terminals indicating which game record is to be used for a particular game play request. Central computer system 12 may also be used as a repository through which pools of game play records are transmitted to player terminals 14 as will be discussed further below.

Those skilled in the art will appreciate that the invention may be embodied in many arrangements other than the illustrative arrangement shown in FIG. 1. For example, a single computer system may generate the game records according to the invention and may also store the game record pools for distribution to several player terminals such as terminals 14. Furthermore, rather than randomizing an entire set of game records and then using the records sequentially, the game records could be drawn randomly from a sequentially arranged set or pool of records. This alternative game record randomization technique is to be considered within the scope of the invention as set forth in the following claims.

Figure 2:
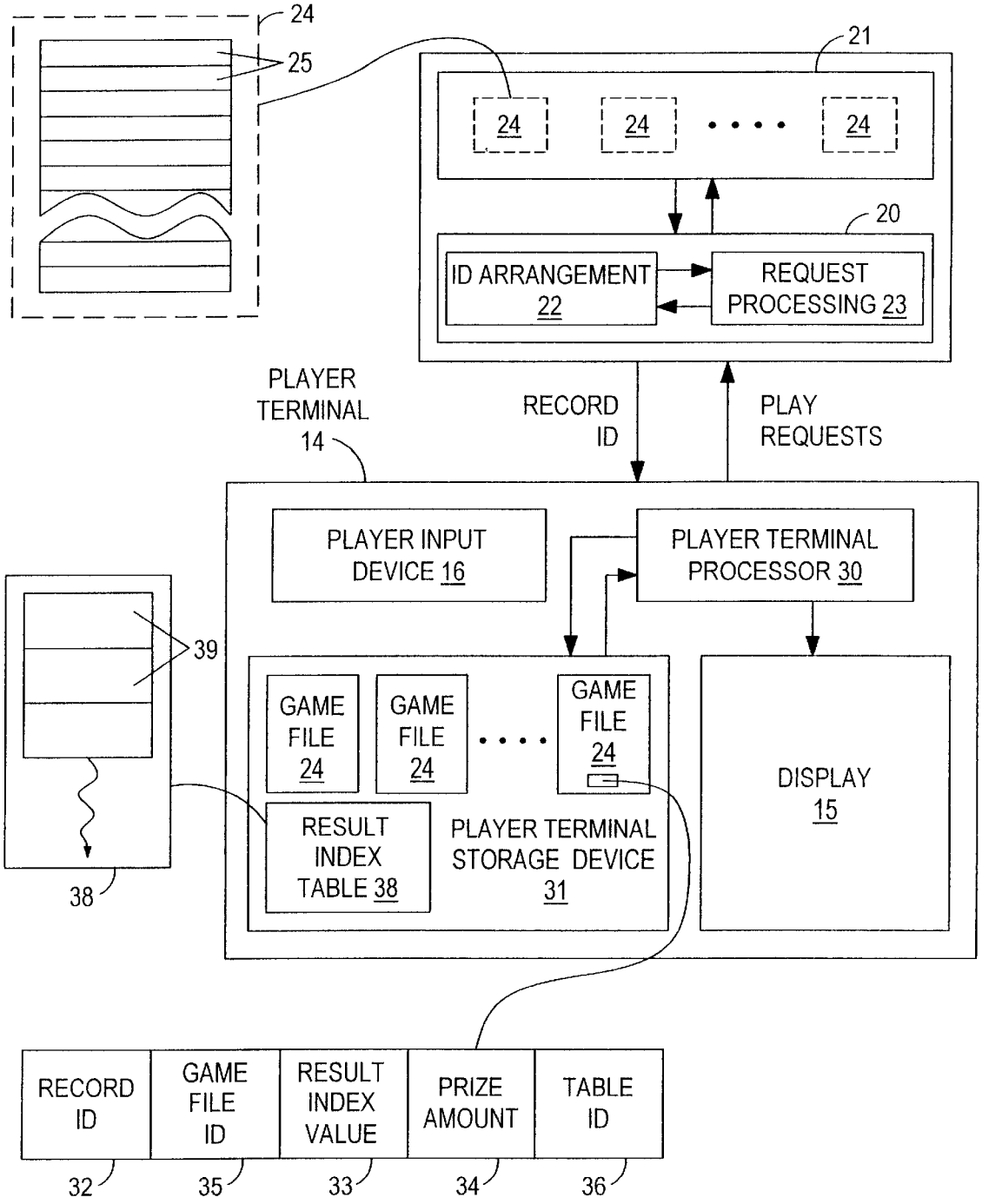
FIG. 2 is a diagrammatic representation of the central processing system and a single player terminal, showing data structures employed in the invention.

Referring to FIG. 2, central computer system 12 includes a central processor 20 and may include a game pool storage device 21. Those skilled in the art will appreciate that central processor 20 includes random access memory and other components which are omitted from the drawing so as not to obscure the invention in unnecessary detail. Central processor 20 executes program code to perform the method steps described below with reference to FIG. 3. In particular, central processor 20 executes program code to implement an identifier arrangement shown at 22 in FIG. 2, and a play request processing arrangement 23. Storage device 21 stores one or more game record files 24, each file comprising a pool of game play records 25.

Identifier arrangement 22 maintains unique record identifiers (not shown) which are used to identify or point to a particular game play record 25 in a particular game record file 24. In one preferred form of the invention, identifier arrangement 22 comprises a counter which maintains the count of game play requests received by central processor 20 for each game, that is, each game record file 24 in play at player terminals 14. The count for a particular game record file 24 represents the unique record identifier for a game play record 25 in that file. For example, the count of "1" may identify or be associated with a first game play record 25 in a particular game record file, while the count of "2" may be associated with a second game play record in the file, and so forth.

Alternatively, to the counter-type identifier arrangement shown in FIG. 2, the record identifiers may be incorporated into the game play records themselves. In this alternative it is useful to store the game record files 24 in storage device 21. A pointer may be associated with each game record file 24 and the pointer moved successively from one game play record 25 to the next to keep track of which record identifier is to be communicated to a particular player terminal 14 and thus which game play record is to be used next at a player terminal. In a further alternative, game play records 25 and the identifier associated with the respective records may be selected randomly from a file 24 through a suitable random selection process. Each game play record 25 which has been selected may be marked by a suitable marker or otherwise removed from selection to ensure a single record is not used a second time.

It should be noted that the present invention may be implemented without storing the game record files 24 at central computer system 12. However, even where the game record files are not used in the identifier arrangement 22, it may be convenient to use storage device 21 at central computer system 12 as a repository for game record files prior to transferring the files to the various player terminals 14.

FIG. 2 shows only a single player terminal 14 in order to simplify the drawing for purposes of describing the invention. It will be appreciated that numerous player terminals 14 may interact with the single central computer system 12, and that the invention is not limited to only a single terminal as shown in FIG. 2. Each player terminal 14 includes a player terminal processor 30, input device 16, display device 15, and a player terminal storage device 31. As will be discussed below with reference to FIG. 3, player terminal processor 30 executes display control program code to access particular game play records 25 from storage device 31 and generate display commands. These display commands are directed to display 15 to cause the display to produce a desired graphic representation. The graphic representation may include a representation of a paper scratch ticket, for example. Alternatively, the graphic representation may be associated with a casino game or any other type of game.

FIG. 2 shows several different game record files 24 stored at storage device 31. This reflects the fact that multiple games may be in play at any given time in the present system, with each game having its own game record pool. Even with one game in play, two or more different game record files 24 may be used alternately in accessing game play records 25. Where different games are in play, the games may be entirely independent or may be related as initial and additional level games. Where multiple game record files 24 are used, each game record file is associated with some identifier to enable central processor 20 to distinguish between files and choose the correct file in response to a play request from player terminal 14.

A preferred form of game play record 25 is shown associated with the game record files 24 stored at player terminal 14. This preferred game play record includes the record identifier 32, a result index value 33, a prize amount 34, a game file identifier 35, and a table identifier 36. The order in which these elements are shown in FIG. 2 is shown only for purposes of example, and any other order may be used within the scope of the invention. Also, certain elements may be stored separately from the game play record 25 as will be discussed below.

Record identifier 32 is included in game record 25 in order to enable the particular game record to be located using the record identifier. Where multiple game files 24 are stored at a given time, game file identifier 35 may also be used to locate the desired game record 25. Alternatively, record identifiers could be unique not only within a single record file 24 but also as between record files. In that case, game file identifier 35 would not be needed to locate a particular game record 25, although it could still be helpful to speed the sorting required to locate a game record.

Result index value 33, prize amount 34, and table identifier 36 comprise the elements from record 25 which relate to the particular result of the game record in the preferred form of the invention. Prize amount 34 simply indicates the amount of the prize associated with the particular record 25. Result index value 33 is a value chosen from a set of unique index values, each value in the set relating to a different result in the game which uses the particular game record 25. For example, in a lottery-type game which imitates draw poker, the set of result index values may include ten different result types chosen to correspond to possible outcomes of a draw poker hand, namely, (1) no value (2) pair of jacks or better (3) two pair, (4) three of a kind, (5) four of a kind, (6) straight, (7) flush, (8) full house, (9) straight flush, and (10) royal flush.

The various result types for a game may be stored in a result index table 38, also stored at the player terminal storage device 31. This result index table 38 may include a series of entries 39 with each entry containing a different index value. Each table entry 39 may also include pointers to processes or programming required to generate the display commands necessary to produce a desired graphic representation. Prize amounts may be incorporated into each index table entry 39 in addition to or instead of being incorporated into each record 25. Also, several different index tables 38 may be required where several games are in play, particularly where the graphics differ between the various games. The table identifier 36 is included in each game play record 25 in order to distinguish between the different index tables 38 where multiple index tables are used. Also, alternatively to using different index tables, information relating index values to prize amounts and graphics processes may also be incorporated in a single index table, with table identifiers 36 included in the various table entries to distinguish the entries.

It will be appreciated that player terminal storage device 31 stores all information required to produce a graphic representation based upon, and consistent with, a record 25 identified by a record identifier 32. Where the graphic representation comprises a representation of a scratch-off ticket, for example, the information required to produce a graphic representation may include a file or object to draw the basic ticket, and files or objects to draw any symbols which may appear on the ticket. For a lottery-type game which imitates draw poker, the graphic producing files or other arrangements of data may include files required to draw representations of the various cards which may be found in a poker hand. In either case, storage device 31 may comprise a mass storage device such as a hard drive associated with the player terminal, or may comprise random access memory or read-only memory associated with player terminal processor 30.

Player input arrangement 16 may comprise a series of input devices (not shown) implemented in any suitable hardware to allow the player to make game play requests. Each player input preferably generates a game identifier 35 chosen from a set of game identifier values. Each game identifier 35 corresponds to a counter or other identifier arrangement 22 at central processor 20 for a particular game file 24 stored at the player terminal 14. Thus, the game index generated from a player input may represent a game play request to central computer system 12 and be used to identify a particular counter or other identifier arrangement 22 implemented at central processor 20 for a given game record file 24 at player terminal 14.

The flow chart shown in FIG. 3 indicates that part of the method according to the invention is performed at the central computer system (12 in FIGS. 1 and 2) and the remainder of the method is performed at the player terminal (14 in FIGS. 1 and 2). The method steps are performed by the respective computer hardware operating under control of computer program code. At central computer system 12, the method includes receiving one or more pools of game play records as shown at process block 40 in FIG. 3. The pools of game records may be embodied in computer files such as game record files 24 shown in FIG. 2, each file containing a series of game play records 25 for a particular game. These pools of game play records are forwarded at step 41 to the various player terminals 14 with which central computer system 12 interacts. The pools of game records may also be stored at the central computer system 12 as indicated at 42.

As shown at process block 43 in FIG. 3, the method performed at central computer system 12 further includes receiving game play requests from player terminal 14. In the preferred form of the invention, several games may be played at a given time, each game using a different game record file 24. Where several game record files are available, a different record identifier arrangement (22 in FIG. 2) will be used for each game record file. In this case the step of receiving the game play request includes using information in the game play request, preferably a game identifier 35, to identify the record identifier arrangement 22 to which the request is to be directed.

The process steps performed at central computer system 12 also include maintaining unique record identifiers, one identifier for each game play record in a pool of such records. These record identifiers 32 are described above with reference to FIG. 2 and the record identifier maintaining step is shown generally at 44 in FIG. 3. In the preferred form of the invention, the identifier arrangements 22 (FIG. 2) used to maintain the identifiers each comprise a counter. As shown in FIG. 3, the step of maintaining the identifiers in this case includes incrementing the respective counter as shown at 46 and then reading the new counter value at step 47. This new value comprises the record identifier 32 (FIG. 2) and identifies the particular game play record 25 which the player is to receive in response to their game play request. Thus, in this implementation of the invention the record identifiers are not maintained together in a table or file, but maintained incrementally as the counter values. Alternatively, the record identifiers could be stored in a table or file and read one at a time using a pointer arrangement or some other arrangement to keep track of the location in the table or file. Regardless of the manner in which the record identifiers are maintained and a particular identifier selected, the program code then causes central computer system 12 to communicate the record identifier to the player terminal 14 as shown at step 48.

As discussed above with reference to FIG. 2, several different game record files 24 may be stored at player terminal 14, each identified by a different game file identifier 35. Where different game record files 24 are stored at player terminal 14, the method at central processing computer system 12 includes communicating the game file identifier 35 back to the player terminal along with the record identifier. The game file identifier 35 may be determined from the information included in the game play request received at step 43.

The method steps performed at player terminal 14 include receiving and storing at least one pool of game play records as shown at step 50 and receiving the record identifier communicated from central computer system 12 as shown at step 51. In multi-level games such as the game described in prior related application Ser. No. 09/479,975, several pools 24 of game play records are in play at any given time. Thus, more than one pool 24 of game play records may be transferred to player terminal 14 both at system start up and to replace exhausted pools in the course of play. The replacement of exhausted pools of game play records will be discussed further below.

Upon receipt of the particular record identifier 32 at step 50, the record identifier is used to access its associated game play record 25 as shown at step 52. In the preferred form of the invention this access step is performed by using the record identifier to sort through a game file 24 to locate the associated record. Where multiple game files 24 are stored at player terminal 14 and the record identifiers are only unique within the individual game files, the game file identifier 35 may be used to identify the correct game file for sorting with the record identifier 32. The game file identifier 35 may be returned from central computer system 12 along with record identifier 32 or may be latched at the terminal in response to the game play request which prompted the receipt of the particular record identifier.

The game record access step 52, in the preferred form of the invention, includes reading at least the result index value 33 from identified record 25, and may include reading the prize amount 34 and table identifier 36. This access information is utilized by display generation program code to generate display commands at step 53. The display commands are then used at step 54 to produce a graphic representation consistent with the result dictated by result index value 33.

Generating the required display commands may be accomplished in several different fashions through suitable display control software at player terminal 14. In one preferred arrangement, the result index table 38 with which the accessed result index value 33 is associated is queried to look up the prize amount associated with the result index value. The table entry for the result index value 33 may also include a pointer to a subroutine or program code. This subroutine is then executed to retrieve image data from an image library stored at player terminal storage device 31. The subroutine arranges the image data as appropriate, and this properly arranged image data represents the display commands which are directed to display 15 through a suitable interface (not shown).

If the game play request (preferably including or comprising a game identifier 35) which prompted receipt of the record identifier 32 indicates that the received record identifier is not related to any other game, as indicated at decision block 60 in FIG. 3, the method may continue with the step of making the indicated payout at step 61. As discussed above, the payout may be in the form of coins or tokens issued at player terminal 14, credits applied at the terminal, or a ticket printed at the terminal, for example.

At decision block 60, if the game play request (game identifier 35) which prompted receipt of the record identifier 32 indicates that the received record identifier is related to another game, then program code executing at player terminal 14 may, at step 62, activate input arrangement 16 at the terminal to enable the player to make some response. A payout step may or may not be included with activation step 62. After either step 61 or 62, player terminal is directed by its program code to wait for an appropriate input from the player. This waiting step is shown at 63 in FIG. 3. Upon entry of the appropriate input, the method includes at step 64 communicating the input as a play request to central computer system 12. As mentioned above, this play request preferably comprises a game identifier 35 generated in response to activation of a particular input button or other input device included in input arrangement 16 at player terminal 14.

Since the game record files 24 (pools of game records) are used up in the course of play, the invention includes an arrangement for monitoring the number of unused game play records 25 remaining in a game record file. This monitoring arrangement may be implemented in a number of fashions. However, the preferred monitoring arrangement at step 66 monitors the counter value for a pool/game record file at step 66 and compares that count to the number of game play records 25 known to be in the file. Once some minimum number of unused records 25 are detected in this fashion, the method preferably includes making a request for an additional pool of records as shown at step 67. In this manner, the new pool of game records may be transferred to player terminals 14 well ahead of the time game records 25 are needed from the pool. Also, the game record files 24 may be transferred over a period of time to ensure no adverse impact on network performance.

The operation of the invention may be described with reference to a specific example and to FIGS. 2 and 3. In a game intended to imitate a draw poker game, a player at player terminal 14 enters an initial play request at step 64. Central computer system 12 receives the game identifier 35 representing the request and selects the identifier arrangement 22 for the game file represented by that game identifier. The preferred identifier arrangement 22 then increments the counter value at step 46 and reads the new counter value as the record identifier at step 47. System 12 then communicates the record identifier 32 to player terminal 14.

Player terminal 14 receives the record identifier at step 51 and then accesses the identified game record 25 at step 52. For purposes of this example, assume that the result index value 33 accessed from the identified game record 25 is associated with the result type "jacks or better." The display control program code operating at player terminal 14 responds to this result index value 33 by generating display commands to produce a graphic representation consistent with that result type. It will be noted that the record identifier 32 communicated from central computer system 12 does not indicate the specific representation nor does it indicate the outcome associated with the game record. Rather the record index is used to look up the result and type of representation, a draw poker hand having the value "jacks or better." It is the display control program code at player terminal 14 which generates the display commands to produce a specific graphic representation consistent with this result type. For example, the display commands generated generally at step 53 in FIG. 3 may produce a graphic representation at display 15 of a draw poker hand including the king of hearts, the king of diamonds, the two of spades, the eight of diamonds, and ten of clubs.

After this graphic representation is produced at display 15 (step 54), the player terminal program code activates input arrangement 16 at step 62 to allow the player to enter some permissible response at player terminal 14. The particular response is communicated to central computer system 12 at step 64 and represents a play request in a particular second level game. The play request is embodied in a game identifier 35 similarly to the request in the preceding game. For purposes of example, assume the player enters a response holding the pair of kings and discarding the remaining cards shown in the graphic representation. Central computer system 12 uses the game identifier 35 associated with this response to select an identifier arrangement 22 for an additional level game which may be referred to as the "jacks or better" game. At step 46 in FIG. 3, the system then increments the counter, reads the new value at step 47, and at step 48 communicates that new counter value to player terminal 14 as the record identifier 32.

In response to the additional record identifier 32 from the additional level game, record access program code at player terminal 14 accesses the identified game record 25 at step 52. The display control program code operating at player terminal 14 then generates second level display commands at step 53 based upon the result index value 33 accessed from the identified game record 25. These commands are then used at step 54 to produce an additional level graphic representation at display 15. This additional level graphic representation displays the outcome of the play to the player and must be consistent both with the graphic representation associated with the initial level game and with the result type associated with the result index 33 from the game record 25 accessed in the additional level game. For example, assume the additional level game record 25 contained a result index value 33 associated with the result type "three of a kind." In this case, the display commands produce a graphic representation comprising three kings and two additional cards which do not add to the value of the hand. Again, the record identifier 32 did not dictate the suit of the additional king or the values of the two other cards. These results are generated by the display control program code operating at player terminal 14. The additional level game representation may include in this example the king of hearts, king of diamonds, king of spades, seven of hearts, and ace of clubs. This representation is thus consistent with the earlier graphic representation in that it retains the two cards held in the player response to the first level game. Additionally, the additional level graphic representation is consistent with the result type associated with the result index value 33 read from the game record 25 identified by the record identifier 32 communicated from central computer system 12 in the additional level game.

The above described preferred embodiments are intended to illustrate the principles of the invention, but not to limit the scope of the invention. Various other embodiments and modifications to these preferred embodiments may be made by those skilled in the art without departing from the scope of the following claims. For example, although the multi-level game described above comprises a two level game, it will be appreciated that the multi-level games may comprise any number of game levels which are graphically related or not. Also, although the discussion in FIG. 3 assumes the identifier arrangement uses a counter, game record identifiers 32 may be selected or generated in any suitable fashion and without utilizing a counter. These alternative record identifier arrangements are discussed with reference to FIG. 2 and are within the scope of the following claims.

What is claimed is:

1. A method for facilitating game play in an electronic lottery game network, the network utilizing at least one player terminal, at least one central processing system, and at least one pool of game play records, each game play record in a pool being associated with a predetermined result, the method including the steps of:

(a) maintaining unique record identifiers at a central processing system, each record identifier being associated with a different game play record in a pool of game play records;

(b) storing the pool of game play records at a player terminal, each game play record in the pool at the player terminal being addressable by the unique identifier associated with the respective game play record;

(c) in response to a game play request communicated to the central processing system from the player terminal, communicating the record identifier associated with a particular game play record from the central processing system to the player terminal;

(d) in response to the record identifier communicated to the player terminal, accessing the particular game play record at the player terminal; and (e) utilizing information accessed from the particular game play record at the player terminal to generate display commands and produce a graphic representation at the player terminal, the graphic representation being consistent with a predetermined result associated with the particular game play record.

2. The method of claim 1 further including the step of:

(a) storing the pool of game play records at the central processing system.

3. The method of claim 2 wherein the step of maintaining unique record identifiers at the central processing system includes the step of:

(a) in each game play record, storing the unique record identifier associated with the respective game play record.

4. The method of claim 1 wherein the step of maintaining unique record identifiers at the central processing system includes the step of:

(a) incrementing from one unique record identifier to another in response to the game play request communicated from the player terminal.

5. The method of claim 4 wherein each unique record identifier comprises a counter value and the step of incrementing from one unique record identifier to another includes the step of:

(a) maintaining a count of game play requests made at the player terminal.

6. The method of claim 1 further including the steps of:

(a) monitoring a number of unused game play records remaining in the pool of game play records stored at the player terminal; and (b) storing a new pool of game play records at the player terminal once the number of unused game play records reaches a minimum value.

7. The method of claim 1 wherein the electronic lottery game network includes at least one additional player terminal and the method includes the steps of:

(a) storing the pool of game play records at each player terminal; and (b) in response to an additional game play request communicated to the central processing system from any of the player terminals, communicating the record identifier associated with a different game play record from the central processing system to the respective player terminal from which the additional game play request originated.

8. The method of claim 1 wherein the electronic lottery game network includes at least one additional pool of game play records and wherein each game play request designates a particular one of the pools of game play records, and the method includes the steps of:

(a) maintaining additional unique record identifiers at the central processing system, each additional record identifier being associated with a different game play record in an additional pool of game play records;

(b) storing each pool of game play records at the player terminal, each game play record in each pool at the player terminal being addressable by the record identifier associated with the respective game play record; and (c) in response to each of a plurality of additional game play requests communicated to the central processing system from the player terminal, communicating a respective record identifier from the central processing system to the player terminal, the respective record identifier being associated with a different game play record in the respective pool designated in the respective game play request.

9. An apparatus for facilitating game play in an electronic lottery game network, the network utilizing at least one player terminal, at least one central processing system, and at least one pool of game play records, each game play record in a pool being associated with a predetermined result, the apparatus including:

(a) an identifier arrangement at a central processing system for maintaining unique record identifiers, each record identifier being associated with a different game play record in a pool of game play records;

(b) a player terminal storage device at a player terminal for storing the pool of game play records, each game play record in the pool stored at the player terminal storage device being addressable by the unique identifier associated with the respective game play record;

(c) a play request processor at the central processing system for causing the record identifier associated with a particular game play record to be communicated from the central processing system to the player terminal in response to a game play request communicated to the central processing system from the player terminal;

(d) a record accessing arrangement at the player terminal for accessing the particular game play record at the player terminal in response to the record identifier communicated to the player terminal; and (e) a display processing arrangement at the player terminal for utilizing information accessed from the particular game play record at the player terminal to generate display commands and produce a graphic representation at the player terminal, the graphic representation being consistent with a predetermined result associated with the particular game play record.

10. The apparatus of claim 9 further including:

(a) a central storage device at the central processing system for storing the pool of game play records at the central processing system.

11. The apparatus of claim 10 wherein each game play record includes the unique record identifier associated with the respective game play record.

12. The apparatus of claim 9 wherein the identifier arrangement at the central processing system includes:

(a) an incrementing arrangement for incrementing from one unique record identifier to another in response to the game play request communicated from the player terminal.

13. The apparatus of claim 12 wherein each unique record identifier comprises a counter value and the incrementing arrangement includes:

(a) a counter arrangement for maintaining a count of game play requests made at the player terminal.

14. The apparatus of claim 9 further including:

(a) a monitoring arrangement for monitoring a number of unused game play records remaining in the pool of game play records stored at the player terminal; and (b) a game pool updating arrangement for storing a new pool of game play records at the player terminal storage device once the number of unused game play records reaches a minimum value.

15. A program product stored on a computer readable medium for facilitating game play in an electronic lottery game network, the network utilizing at least one player terminal, at least one central processing system, and at least one pool of game play records, each game play record in a pool being associated with a predetermined result, the program product comprising:

(a) record storage program code for storing at least one pool of game play records at a player terminal, each game play record in the pool at the player terminal being addressable by a unique identifier associated with the respective game play record;

(b) play request processing program code for responding to a game play request at the player terminal by causing the record identifier associated with a particular game play record to be communicated from a central processing system to the player terminal;

(c) record access program code for accessing the particular game play record at the player terminal in response to the record identifier communicated to the player terminal; and (d) display control program code for utilizing information from the particular game play record at the player terminal to generate display commands for producing a graphic representation at the player terminal, the graphic representation being consistent with a predetermined result associated with the particular game play record.

16. The program product of claim 15 wherein:

(a) the record storage program code also causes the pool of game play records to be stored at the central processing system.

17. The program product of claim 16 wherein each game play record includes the unique record identifier associated with the respective game play record.

18. The program product of claim 15 further including:

(a) record selection program code for incrementing from one unique record identifier to another in response to the game play request communicated from the player terminal.

19. The program product of claim 18 wherein each unique record identifier comprises a counter value and the record selection program code includes:

(a) counter program code for maintaining a count of game play requests entered at the player terminal.

20. The program product of claim 15 further including:

(a) monitoring program code for monitoring a number of unused game play records remaining in the pool of game play records stored at the player terminal; and (b) pool updating program code for causing a new pool of game play records to be stored at the player terminal once the number of unused game play records reaches a minimum value.

* * * * *